US009986832B2

(12) United States Patent
LaPointe et al.

(10) Patent No.: US 9,986,832 B2
(45) Date of Patent: Jun. 5, 2018

(54) FURNITURE MEMBER WITH WALL-PROXIMITY MECHANISM

(71) Applicant: La-Z-Boy Incorporated, Monroe, MI (US)

(72) Inventors: Larry P. LaPointe, Temperance, MI (US); Richard E. Marshall, Monroe, MI (US)

(73) Assignee: La-Z-Boy Incorporated, Monroe, MI (US)

( * ) Notice: Subject to any disclaimer, the term of this patent is extended or adjusted under 35 U.S.C. 154(b) by 233 days.

(21) Appl. No.: 15/174,060

(22) Filed: Jun. 6, 2016

(65) Prior Publication Data

US 2017/0347796 A1 Dec. 7, 2017

(51) Int. Cl.
*A47C 1/034* (2006.01)
*A47C 1/027* (2006.01)

(52) U.S. Cl.
CPC ..... *A47C 1/034* (2013.01); *A47C 1/027* (2013.01)

(58) Field of Classification Search
None
See application file for complete search history.

(56) References Cited

U.S. PATENT DOCUMENTS 3,941,417 A * 3/1976 Re ..... A47C 1/0352 297/322
4,373,602 A * 2/1983 Tomita ..... B62M 7/04 180/227
4,492,407 A * 1/1985 Broadhead ..... A61G 15/02 297/322
4,582,435 A * 4/1986 Davis ..... E05D 11/081 384/129
4,650,211 A * 3/1987 Tanahashi ..... B60G 3/20 280/124.135
4,932,927 A 6/1990 Fillar
5,072,988 A 12/1991 Plunk
(Continued)

FOREIGN PATENT DOCUMENTS

WO WO-2015-066030 A1 5/2015

OTHER PUBLICATIONS

International Search Report and Written Opinion of the International Searching Authority for PCT/US2017/035976, dated Aug. 25, 2017.

*Primary Examiner* — David E Allred
(74) *Attorney, Agent, or Firm* — Harness, Dickey & Pierce, P.L.C.

(57) ABSTRACT

A furniture member may include a base frame, a seat assembly, a drive rod, a legrest mechanism, and a wall-proximity mechanism. The seat assembly is supported by the base frame and includes a seat frame, a seat bottom, a seatback and a legrest. The legrest is movable relative to the base frame and seat frame between a retracted position and an extended position. The seatback is movable relative to the base frame and seat frame between an upright position and a reclined position. The drive rod is rotatably mounted to the seat frame. The legrest mechanism is attached to the legrest and the seat frame and is driven by the drive rod. The wall-proximity mechanism is connected to the base frame and to the seat assembly and tilts the seat frame rearward relative to the base frame and translates the seat frame forward relative to the base frame.

28 Claims, 18 Drawing Sheets

(56) References Cited

U.S. PATENT DOCUMENTS

| | | | | |
|---|---|---|---|---|
| 5,570,927 | A * | 11/1996 | LaPointe | A47C 1/0352 297/318 |
| 5,772,278 | A | 6/1998 | Kowalski | |
| 6,179,328 | B1 * | 1/2001 | Kawagoe | B60G 9/003 280/124.106 |
| 6,330,995 | B1 * | 12/2001 | Mangeiga | B64D 27/26 244/54 |
| 6,467,845 | B1 * | 10/2002 | Chen | A47C 1/027 297/300.8 |
| 6,939,076 | B2 * | 9/2005 | LaPointe | F16C 11/04 297/68 |
| 7,850,232 | B2 * | 12/2010 | Casteel | A47C 1/0352 297/68 |
| 8,132,855 | B2 * | 3/2012 | Richard | A47C 1/0345 297/423.28 |
| 2006/0249992 | A1 * | 11/2006 | LaPointe | A47C 1/0345 297/68 |
| 2006/0249993 | A1 | 11/2006 | Rogers | |
| 2007/0241589 | A1 * | 10/2007 | LaPointe | A47C 1/0355 297/85 L |
| 2009/0284054 | A1 * | 11/2009 | Humer | B60N 2/66 297/216.12 |
| 2017/0101188 | A1 * | 4/2017 | Auge | B64D 11/0644 |
| 2017/0367483 | A1 * | 12/2017 | Fecker | A47C 1/027 |

* cited by examiner

FURNITURE MEMBER WITH WALL-PROXIMITY MECHANISM

FIELD

The present disclosure relates to a furniture member with a wall-proximity mechanism.

BACKGROUND

This section provides background information related to the present disclosure and is not necessarily prior art.

Conventional reclining chairs or sofas must be positioned far enough away from a wall or any other object in a room to provide enough space behind the chair or sofa so that the wall does not restrict the ability of a seatback of the chair or sofa to move into a fully reclined position. This can result in the user having to position the chair or sofa farther away from the wall than he or she would choose to position a non-reclining chair or sofa in order to leave space for the seatback to fully recline. The present disclosure provides a furniture member that translates a frame of the furniture member forward as the seatback reclines, such that a distance between the wall and the seatback is the same or nearly the same in both an upright position and in a fully reclined position.

SUMMARY

This section provides a general summary of the disclosure, and is not a comprehensive disclosure of its full scope or all of its features.

An aspect of disclosure provides a furniture member that may include a base frame, a seat assembly, a drive rod, a legrest mechanism and a wall-proximity mechanism. The seat assembly may be supported by the base frame and may include a seat frame, a seat bottom, a seatback and a legrest. The legrest is movable relative to the base frame and seat frame between a retracted position and an extended position. The seatback may be movable relative to the base frame and seat frame, and independently of the legrest, between an upright position and a reclined position. The drive rod may be rotatably mounted to the seat frame. The legrest mechanism may be attached to the legrest and the seat frame and may be driven by the drive rod to move the legrest between the retracted and extended positions. The wall-proximity mechanism may be connected to the base frame, the seat assembly, and the drive rod and may tilt the seat frame rearward relative to the base frame and translate the seat frame forward relative to the base frame in response to rotation of the drive rod and movement of the seatback between the upright and reclined positions. The wall-proximity mechanism may include a first motion link and a second motion link that are mounted to the base frame and pivotable relative to the base frame about first and second rotational axes, respectively. The first and second rotational axes may extend through the base frame and may be fixed relative to the base frame.

In some configurations, the wall-proximity mechanism includes a first linkage including the first and second motion links, a first cross member pivotably connected to intermediate portions of the first and second motion links, first and second control links pivotably connected to second ends of the first and second motion links, respectively, a second cross member having ends pivotably connected to ends of the first and second control links, a first connecting link pivotably connected to one of the ends of the second cross member, a second connecting link pivotably connected to an intermediate portion of the second cross member and pivotably connected to the first motion link, a crank link rotationally fixed to the drive rod and pivotably connected to a third connecting link that is also pivotably connected to the first connecting link, and first and second mounting links fixedly attached to the seat frame. The first mounting link may be pivotably connected to an intermediate portion of the first connecting link. The second mounting link may be pivotably connected to the second cross member.

In some configurations, the wall-proximity mechanism includes a second linkage including a first pull link, a second pull link, and a third pull link, the first pull link pivotably connected to the base frame and to the second pull link. The second pull link may be pivotably coupled to the drive rod and pivotably coupled to the third pull link. The third pull link may be pivotably coupled to the seat bottom.

In some configurations, the first pull link is rotatable relative to the base frame about a third rotational axis that extends through the base frame and is fixed relative to the base frame.

In some configurations, the wall-proximity mechanism is non-slidably and non-rollingly connected to the seat bottom and to the base frame.

In some configurations, the legrest mechanism includes a pantograph linkage connected to the drive rod.

In some configurations, the furniture member includes a friction-slide mechanism including a lever fixedly attached to the seatback and a slide member fixedly attached to the seat bottom. The lever may include a protrusion slidably received within a curved slot formed in the slide member.

In some configurations, the lever rotatably engages the slide member at a location that is spaced apart from the protrusion and the curve slot.

In some configurations, the furniture member includes means for adjusting a frictional force between the lever and the slide member.

In some configurations, the furniture member includes a joint assembly rotatably coupling two links and including a bushing disposed between the two links. The bushing may include a central aperture that is aligned with apertures in the two links, an inner annular flange surrounding the central aperture, and an outer annular flange surrounding the inner flange.

In some configurations, the bushing provides clearance for the two links to move relative to each other, and wherein the two links have continuous cross-sectional profiles that extend the entire longitudinal lengths of the two links.

In some configurations, the inner annular flange has a first thickness and the outer annular flange has a second thickness that is greater than the first thickness. The first and second thicknesses may be measured in a direction parallel to an axis about which the two links are rotatably coupled. The difference between the first and second thicknesses of the inner and outer annular flanges locally deforms the two links.

In some configurations, the furniture member includes a rivet extending through the central aperture and the apertures in the two links.

In some configurations, the two links include cup-shaped profiles. In some configurations, the cup-shaped cross-sectional profiles extend the entire longitudinal lengths of the two links In some configurations, one of the two links includes the first motion link or the second motion link.

Another aspect of the present disclosure provides a furniture member that may include a base frame, a seat assembly, a drive rod, a legrest mechanism, a wall-proximity mechanism, and a joint assembly. The seat assembly may be supported by the base frame and may include a seat frame, a seat bottom, a seatback and a legrest. The legrest may be movable relative to the base frame and seat frame between a retracted position and an extended position. The seatback may be movable relative to the base frame and seat frame independently of the legrest between an upright position and a reclined position. The drive rod may be rotatably mounted to the seat frame. The legrest mechanism may be attached to the legrest and the seat frame and may be driven by the drive rod to move the legrest between the retracted and extended positions. The wall-proximity mechanism may be connected to the base frame and to the seat assembly to tilt the seat frame rearward relative to the base frame and translate the seat frame forward relative to the base frame. The joint assembly may rotatably couple two links and may include a bushing disposed between the two links. The bushing may include a central aperture that is aligned with apertures in the two links, an inner annular flange surrounding the central aperture, and an outer annular flange surrounding the inner flange.

In some configurations, the wall-proximity mechanism tilts the seat frame rearward relative to the base frame and translates the seat frame forward relative to the base frame in response to rotation of the drive rod and movement of the seatback between the upright and reclined positions.

In some configurations, the wall-proximity mechanism includes a first motion link and a second motion link that are mounted to the base frame and pivotable relative to the base frame about first and second rotational axes, respectively. The first and second rotational axes may extend through the base frame and may be fixed relative to the base frame.

Another aspect of the present disclosure provides a furniture member that may include a base frame, a seat assembly, a legrest mechanism and a joint assembly. The seat assembly may be supported by the base frame and may include a seat frame, a seat bottom, a seatback and a legrest. The legrest may be movable relative to the base frame and seat frame between a retracted position and an extended position. The seatback may be movable relative to the base frame and seat frame between an upright position and a reclined position. The legrest mechanism may be attached to the legrest and the seat frame and may move the legrest between the retracted and extended positions. The joint assembly may rotatably couple two links and may include a bushing disposed between the two links. The bushing may include a central aperture that is aligned with apertures in the two links, an inner annular flange surrounding the central aperture, and an outer annular flange surrounding the inner flange.

Another aspect of the present disclosure provides a furniture member that may include a base frame, a seat assembly, a drive rod, a legrest mechanism, a wall-proximity mechanism, and a friction-slide mechanism. The seat assembly may be supported by the base frame and may include a seat frame, a seat bottom, a seatback and a legrest. The legrest may be movable relative to the base frame and seat frame between a retracted position and an extended position. The seatback may be movable relative to the base frame and seat frame independently of the legrest between an upright position and a reclined position. The drive rod may be rotatably mounted to the seat frame. The legrest mechanism may be attached to the legrest and the seat frame and may be driven by the drive rod to move the legrest between the retracted and extended positions. The wall-proximity mechanism may be connected to the base frame and to the seat assembly to tilt the seat frame rearward relative to the base frame and translate the seat frame forward relative to the base frame. The friction-slide mechanism may include a lever fixedly attached to the seatback and a slide member fixedly attached to the seat bottom. The lever may include a protrusion slidably received within a curved slot formed in the slide member.

Another aspect of the present disclosure provides a furniture member that may include a base frame, a seat assembly, a legrest mechanism and a friction-slide mechanism. The seat assembly may be supported by the base frame and may include a seat frame, a seat bottom, a seatback and a legrest. The legrest may be movable relative to the base frame and seat frame between a retracted position and an extended position. The seatback may be movable relative to the base frame and seat frame between an upright position and a reclined position. The legrest mechanism may be attached to the legrest and the seat frame and may move the legrest between the retracted and extended positions. The joint assembly may rotatably couple two links and may include a bushing disposed between the two links. The bushing may include a central aperture that is aligned with apertures in the two links, an inner annular flange surrounding the central aperture, and an outer annular flange surrounding the inner flange. The friction-slide mechanism may include a lever fixedly attached to the seatback and a slide member fixedly attached to the seat bottom. The lever may include a protrusion slidably received within a curved slot formed in the slide member.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Figure 1:
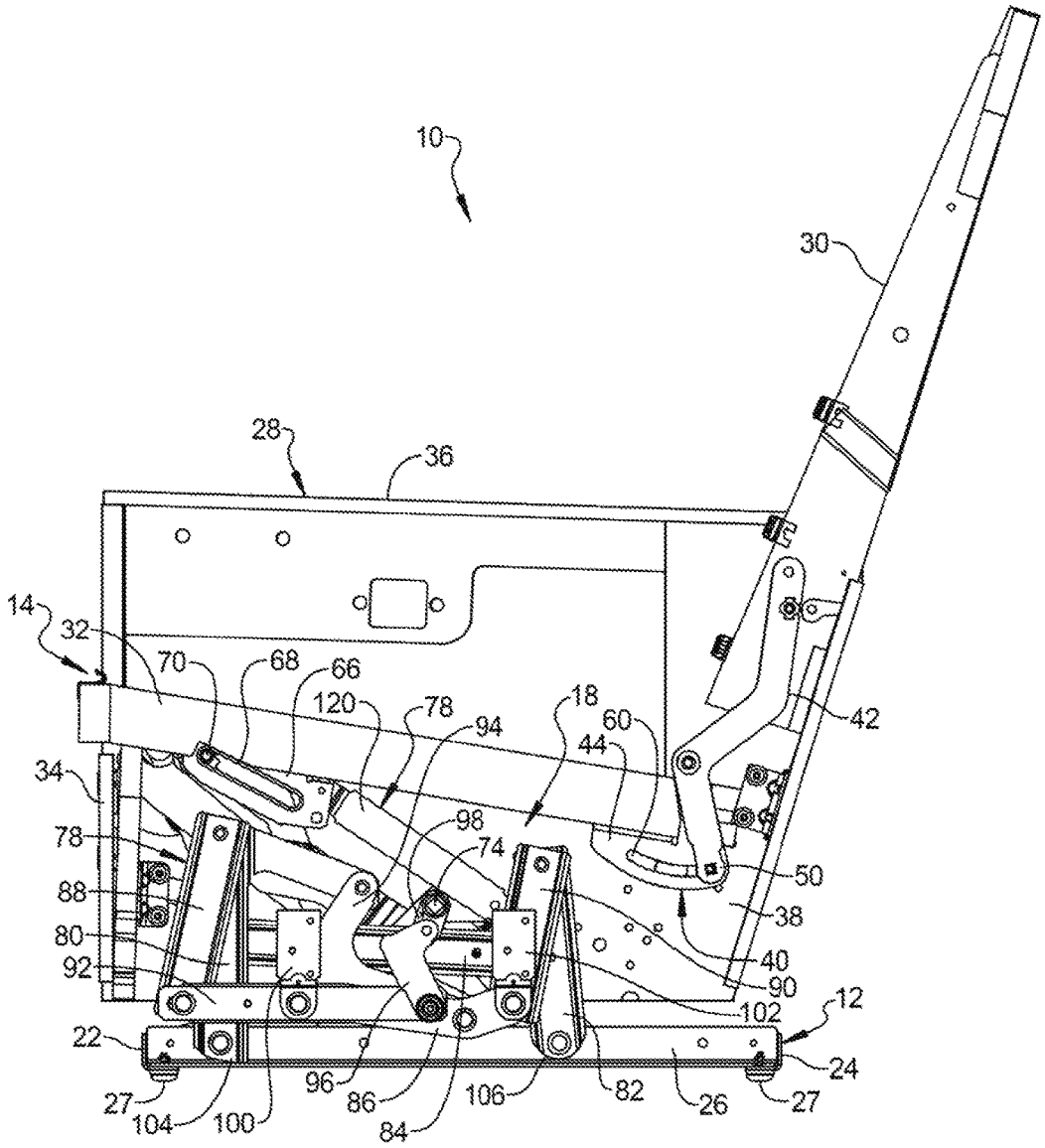
FIG. 1 is a side view of a furniture member with a seatback in an upright position and a legrest in a retracted position according to the principles of the present disclosure.

Example embodiments will now be described more fully with reference to the accompanying drawings.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

Figure 10:
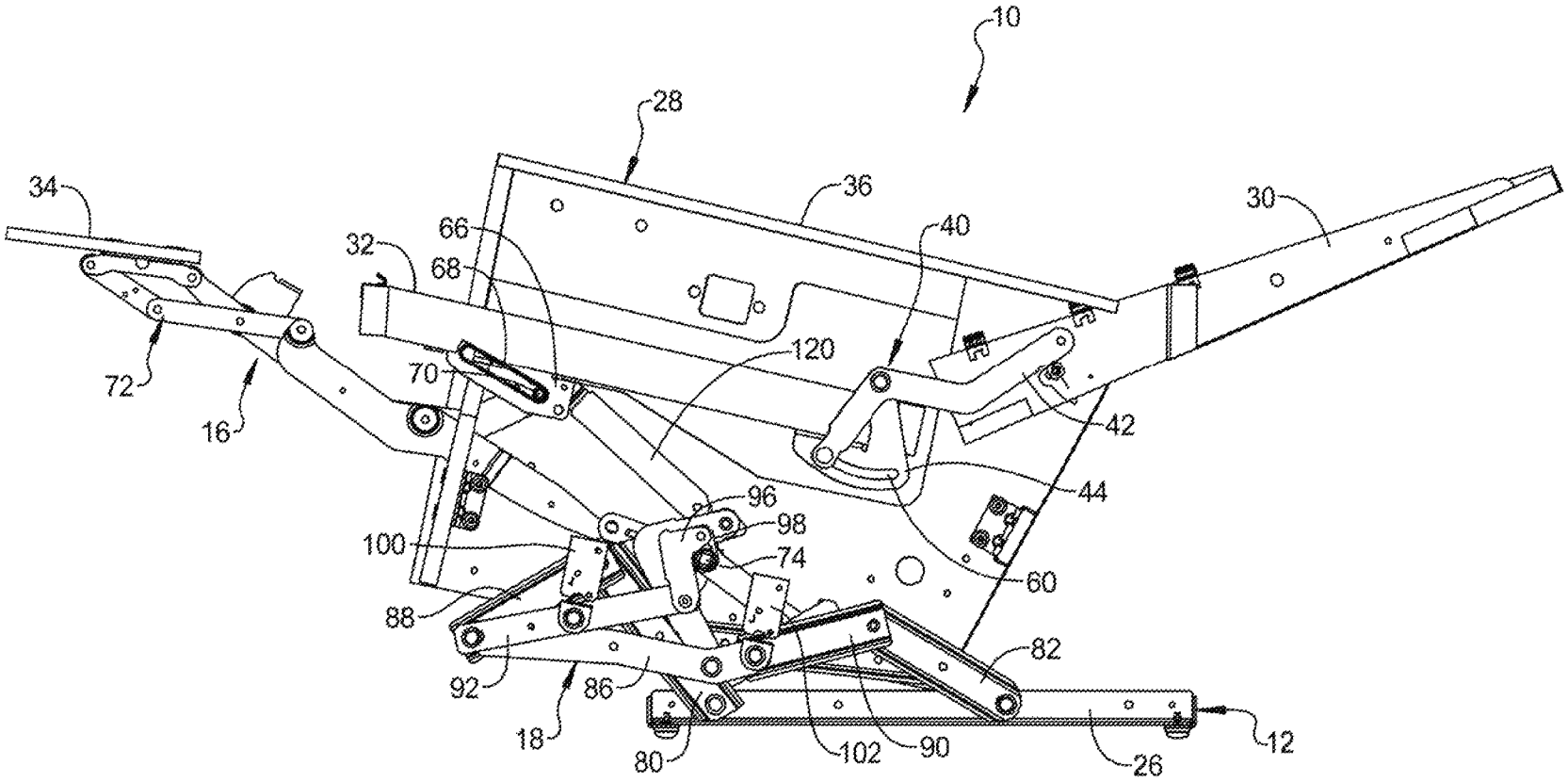
FIG. 10 is a side view of the furniture member with the seatback in a reclined position and the legrest in the extended position according to the principles of the present disclosure.
Figure 11:
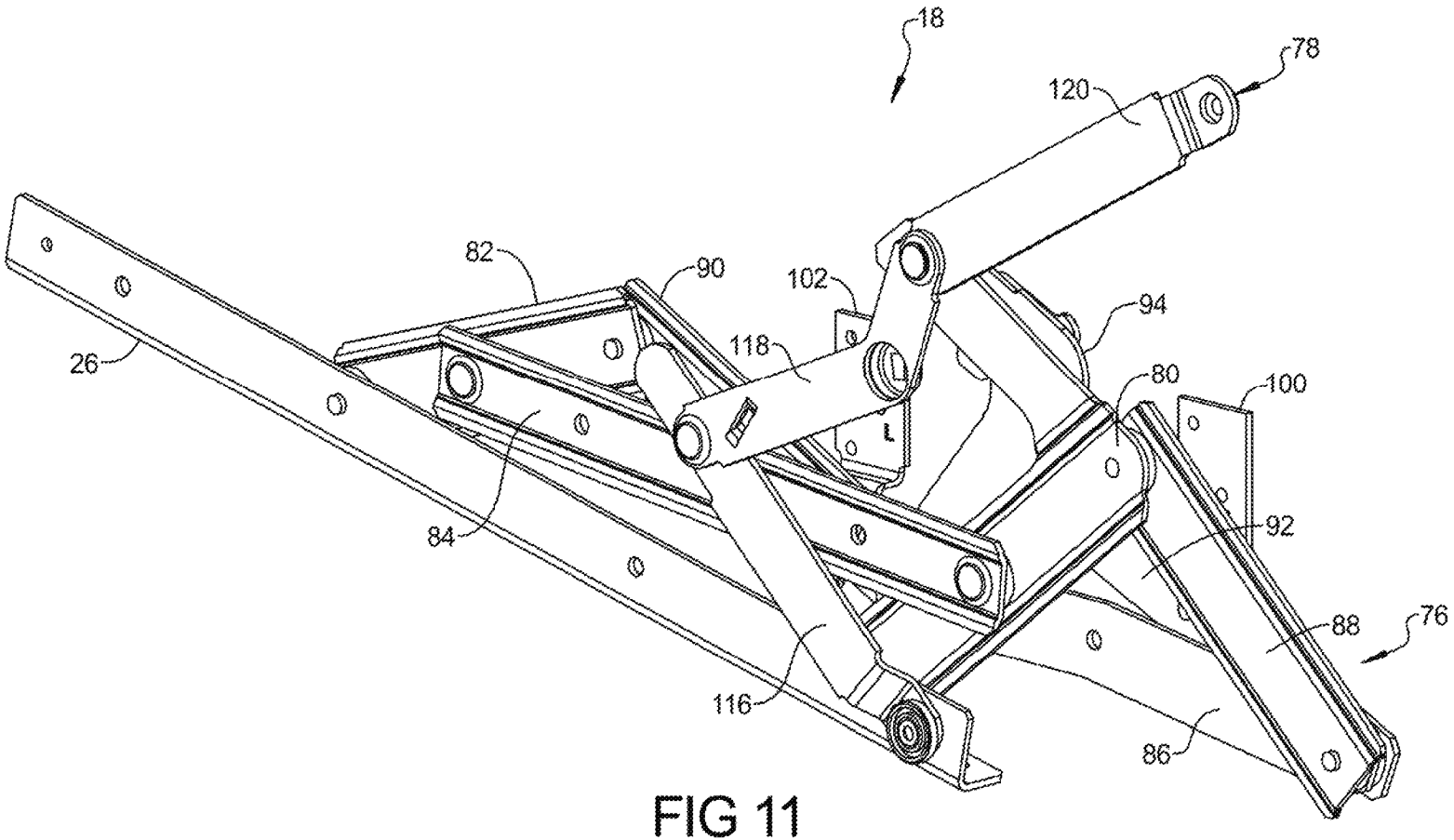
FIG. 11 is a perspective view of the wall-proximity mechanism of the furniture member when the furniture member is in the position of FIG. 10.
Figure 12:
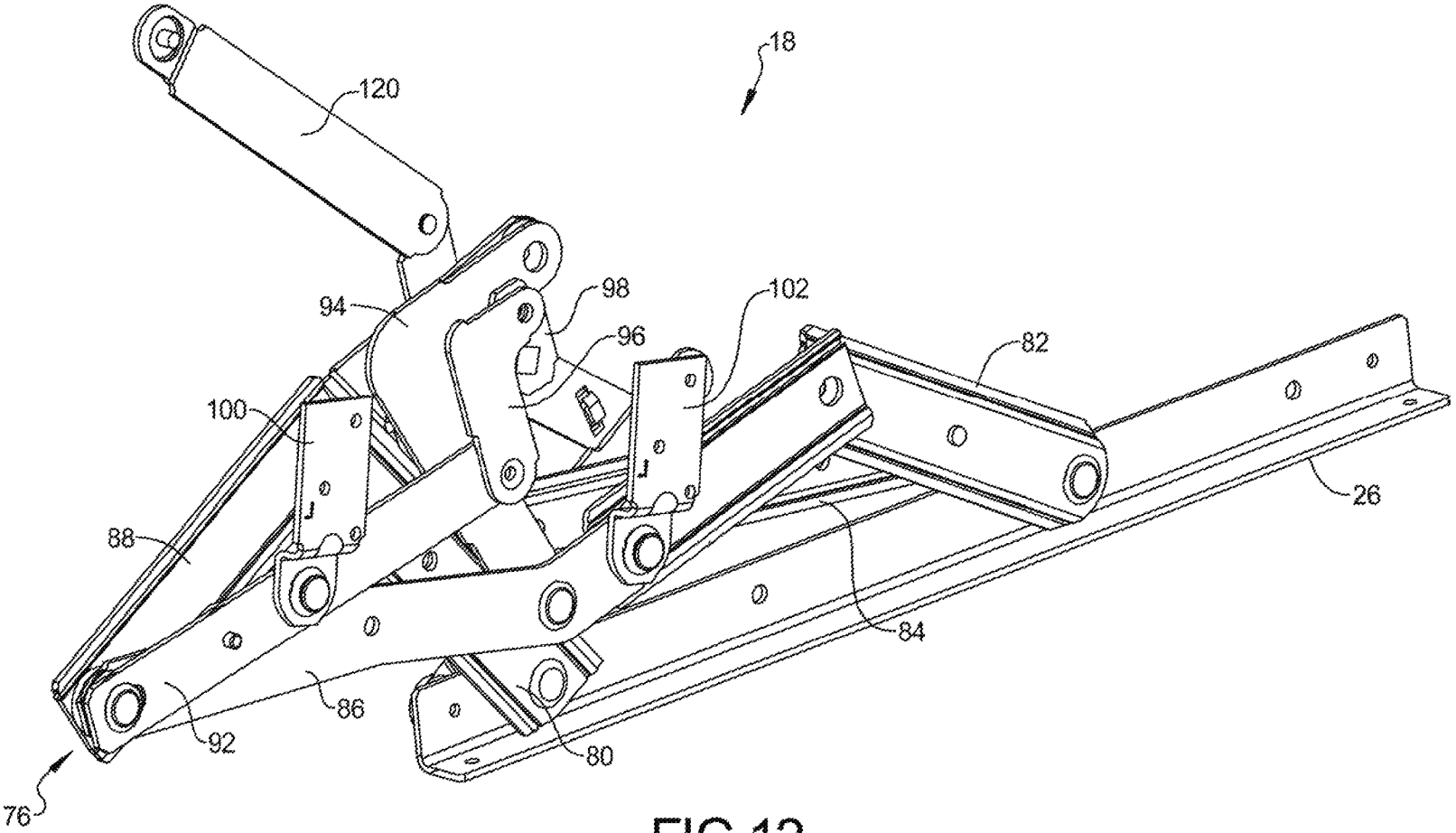
FIG. 12 is a perspective view of the opposite side of the wall-proximity mechanism of the furniture member when the furniture member is in the position of FIG. 10.
Figure 13:
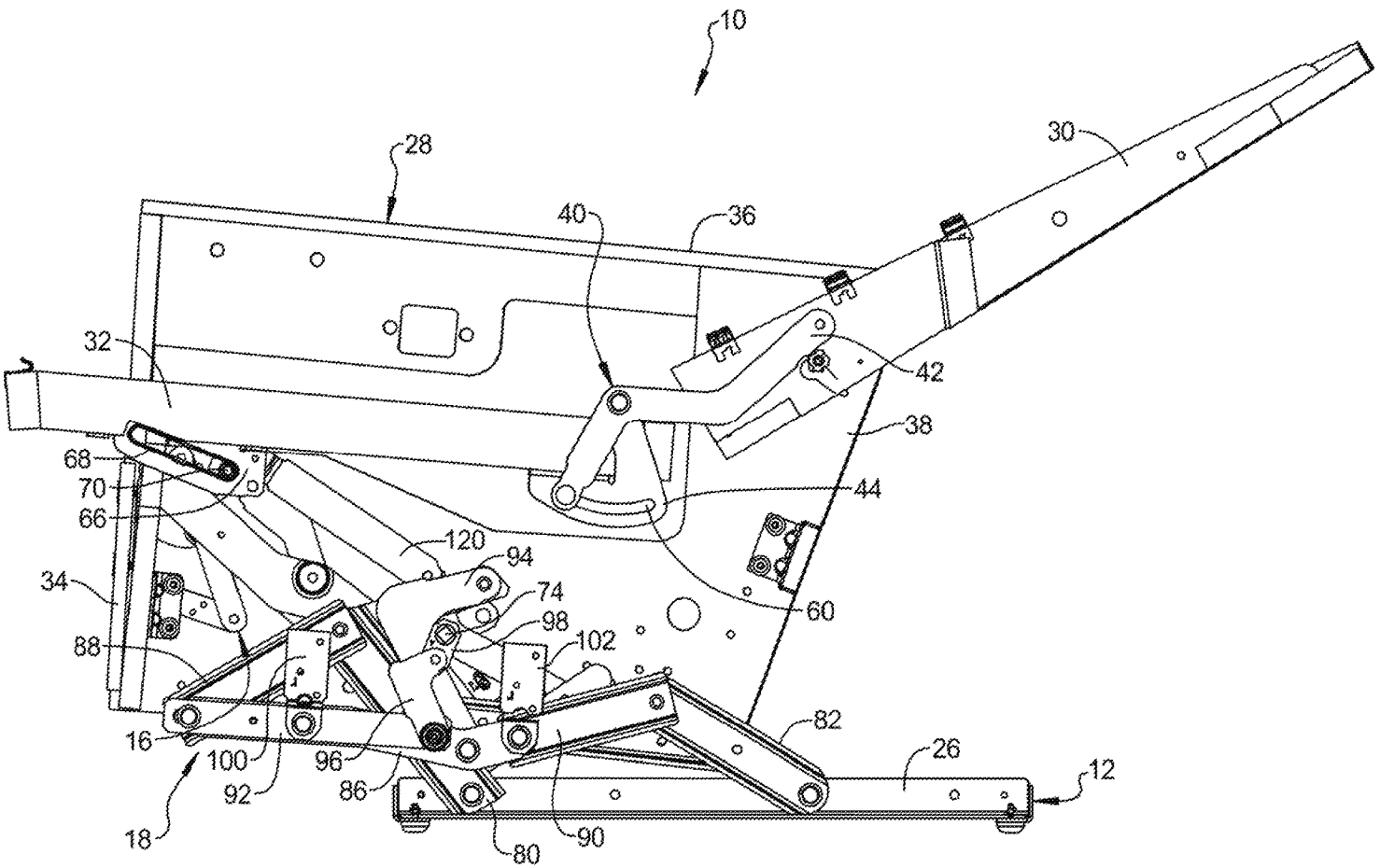
FIG. 13 is a side view of the furniture member with the seatback in the reclined position and the legrest in the retracted position according to the principles of the present disclosure.
Figure 14:
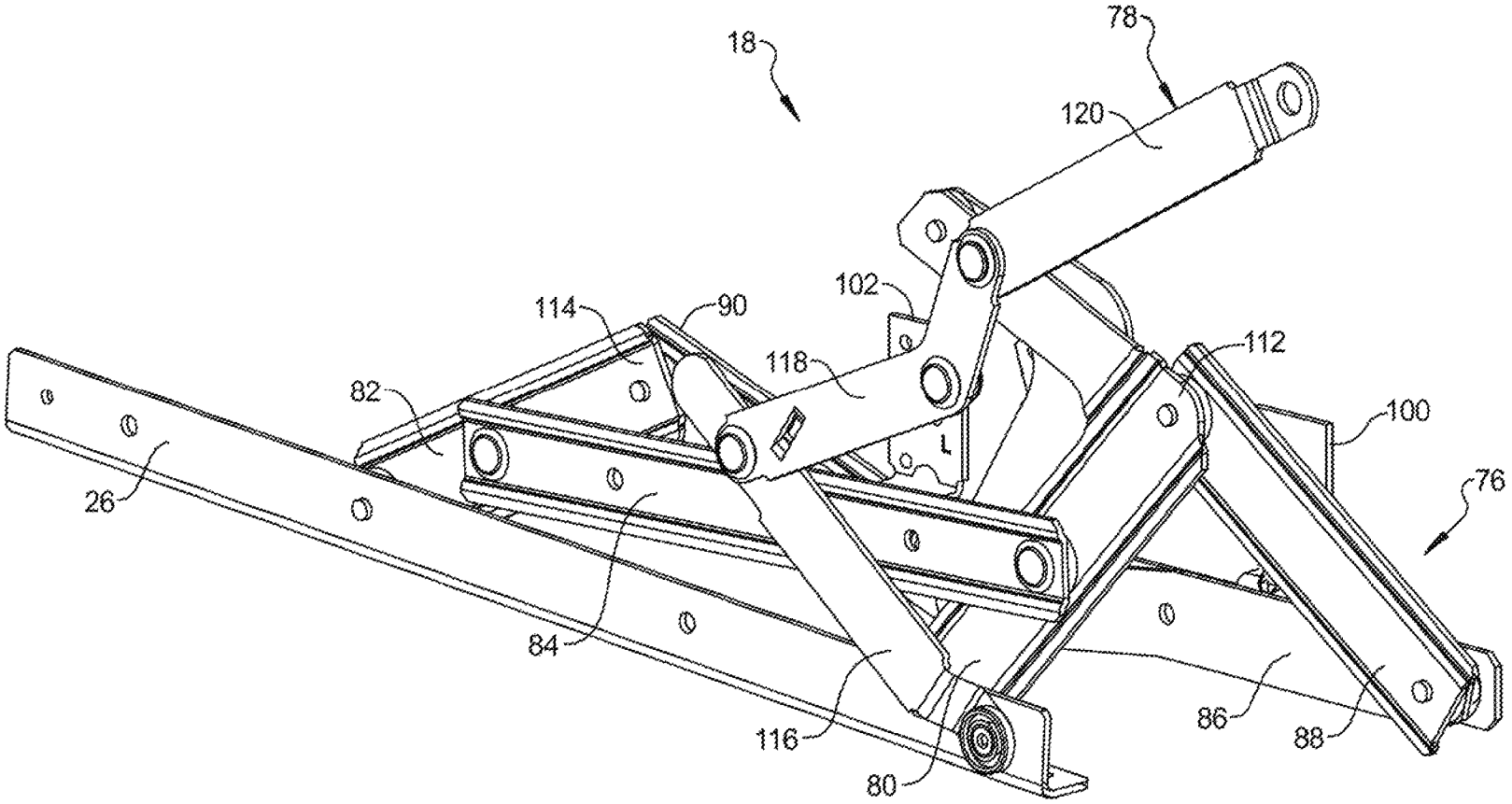
FIG. 14 is a perspective view of the wall-proximity mechanism of the furniture member when the furniture member is in the position of FIG. 13.
Figure 15:
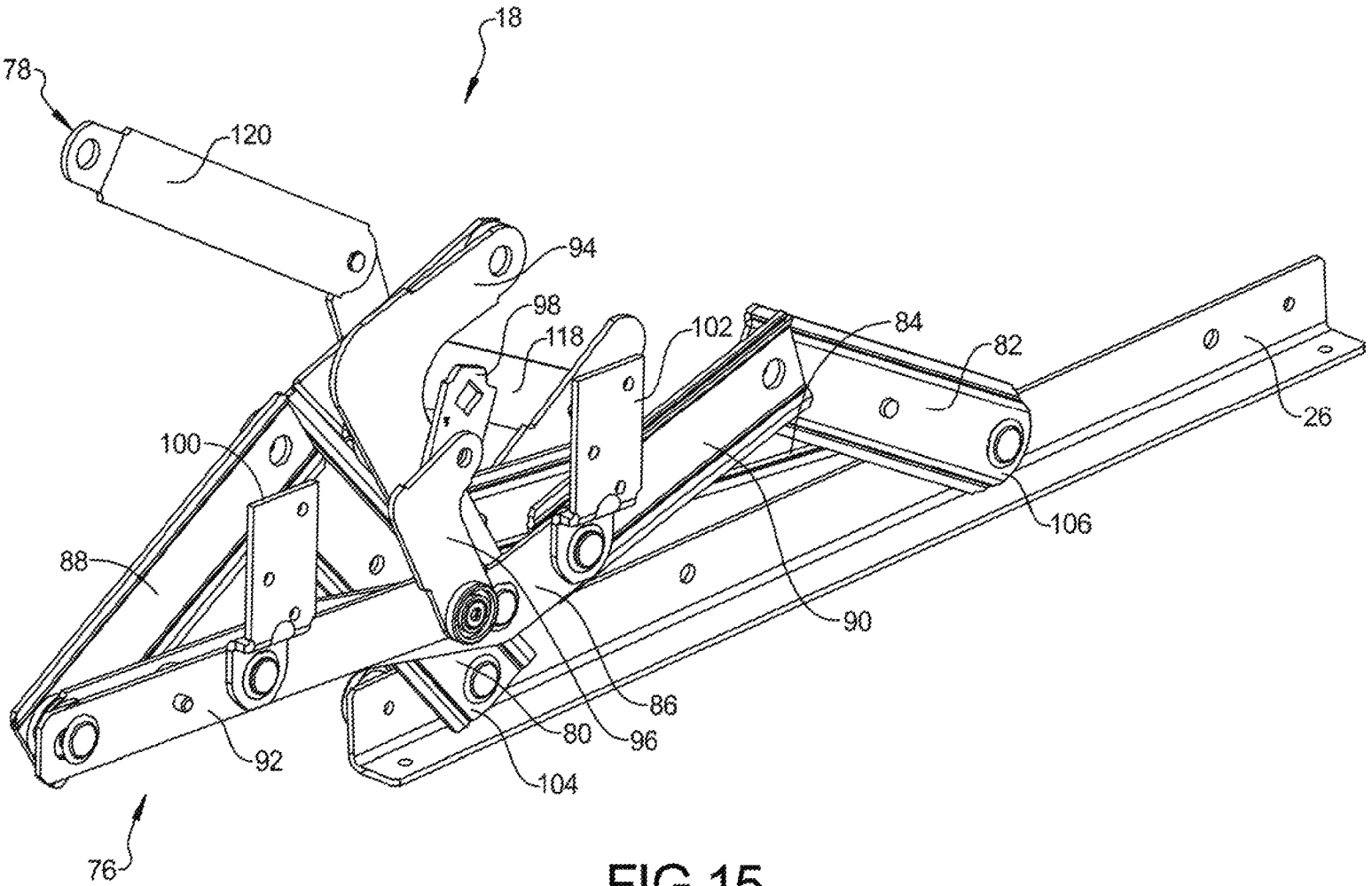
FIG. 15 is a perspective view of the opposite side of the wall-proximity mechanism of the furniture member when the furniture member is in the position of FIG. 13.
Figure 16:
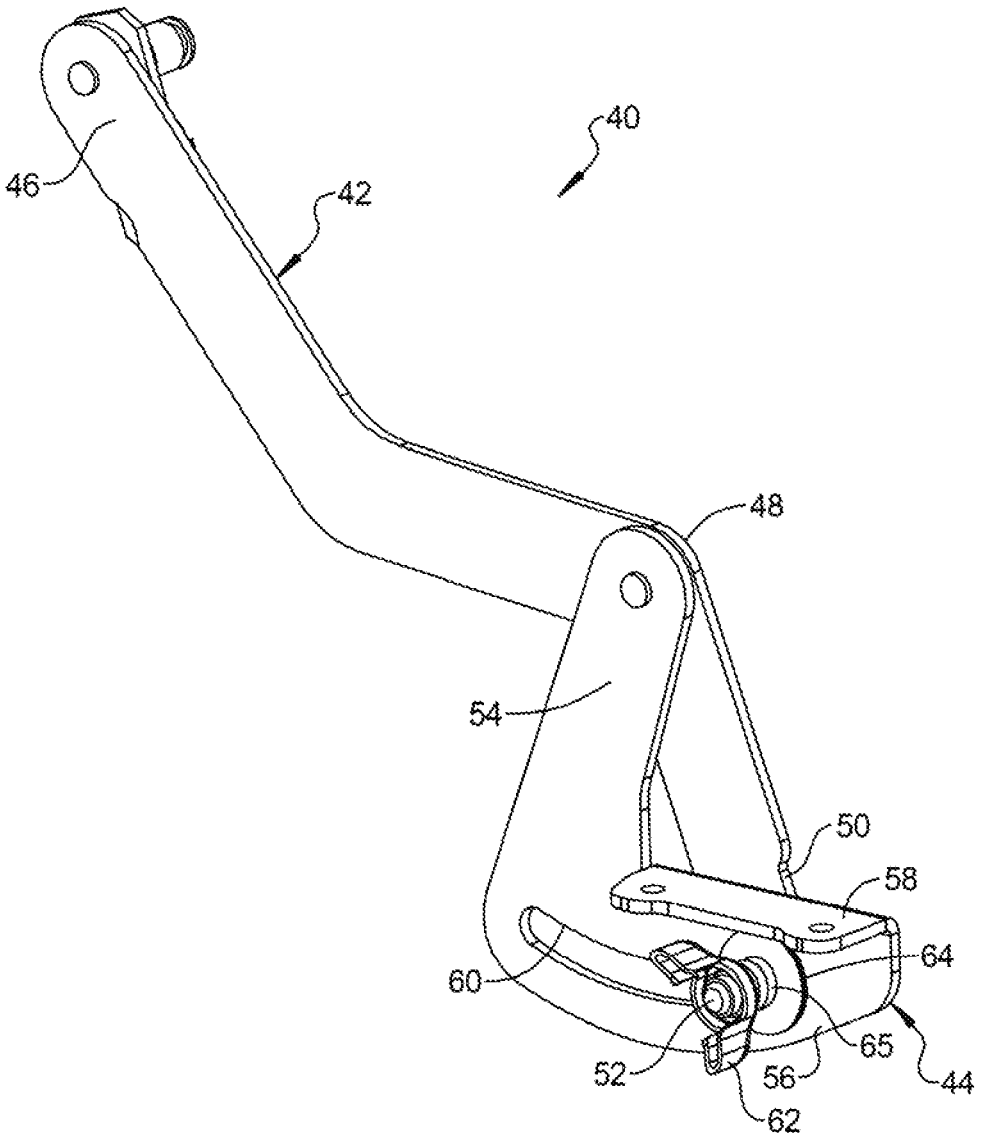
FIG. 16 is a perspective view of the friction-slide mechanism of the furniture member when the seatback is in the reclined position.

With reference to FIGS. 1-18, a furniture member 10 is provided that may include a base frame 12, a seat assembly 14, a legrest mechanism 16, and a wall-proximity mechanism 18. As will be described in more detail below, the wall-proximity mechanism 18 may tilt the seat assembly 14 rearward relative to the base frame 12 and translate the seat assembly 14 forward relative to the base frame 12 in response to movement of the legrest mechanism 16 between a fully retracted position (FIGS. 1 and 13) and a fully extended position (FIGS. 6 and 10) and/or in response to movement of a seatback 30 of the seat assembly 14 between a fully upright position (FIGS. 1 and 6) and a fully reclined position (FIGS. 10 and 13).

Figure 2:
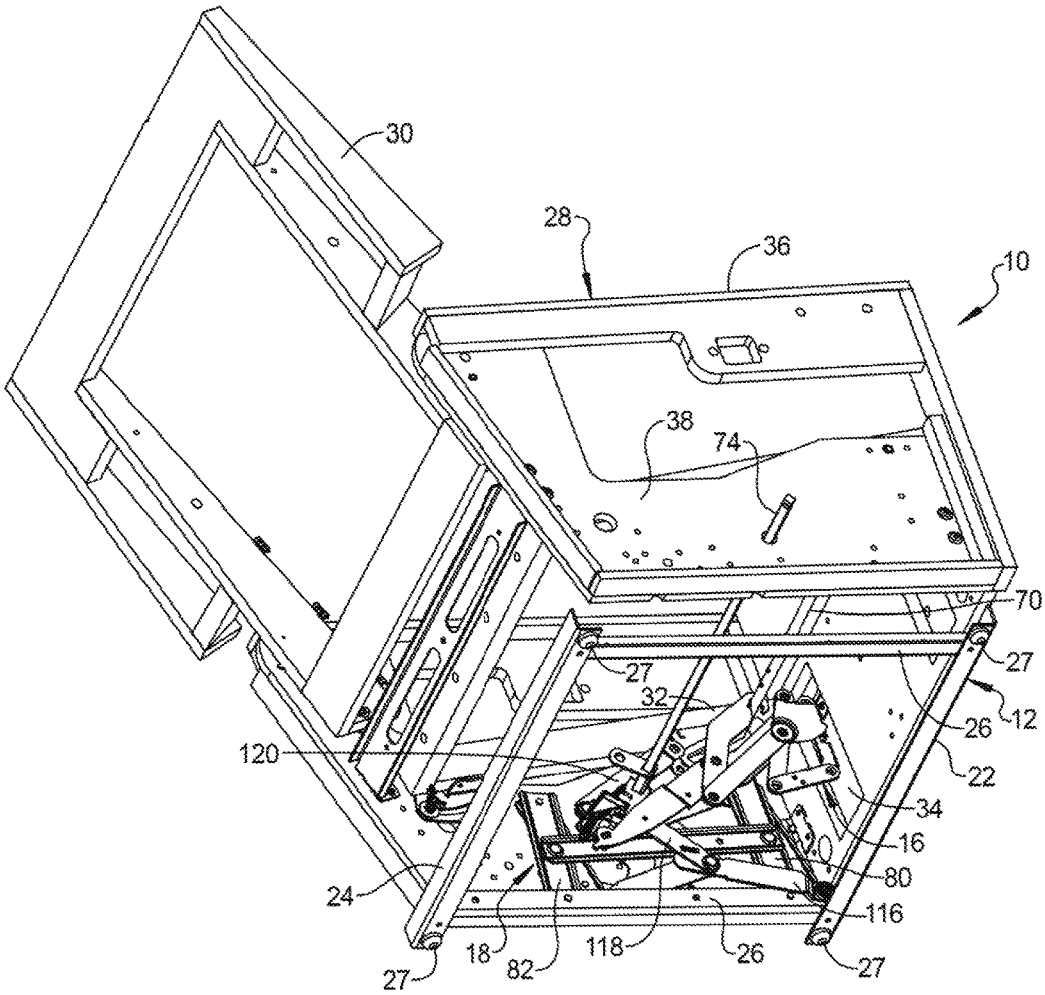
FIG. 2 is a perspective view of the furniture member in the position of FIG. 1.

Referring now to FIGS. 1 and 2, the base frame 12 may include a plurality of stationary beams including, for example, a front support member 22, a rear support member 24, and a pair of side support members 26 (only one of which is shown in the figures). The side support members 26 are spaced apart from each other and are attached to and extend between the front and rear support members 22, 24. Feet 27 may be attached to some or all of the support members 22, 24, 26.

As shown in FIGS. 1, 6, 10 and 13, the seat assembly 14 may include a seat frame 28, the seatback 30, a seat bottom 32, and a legrest platform 34. The seat frame 28 may include a plurality of armrests 36 and a seat base 38 that supports the seatback 30, the seat bottom 32 and the legrest mechanism 16. The seatback 30 is rotatably coupled to the seat base 38 to allow the seatback 30 to rotate between the fully upright and fully reclined positions.

Figure 5:
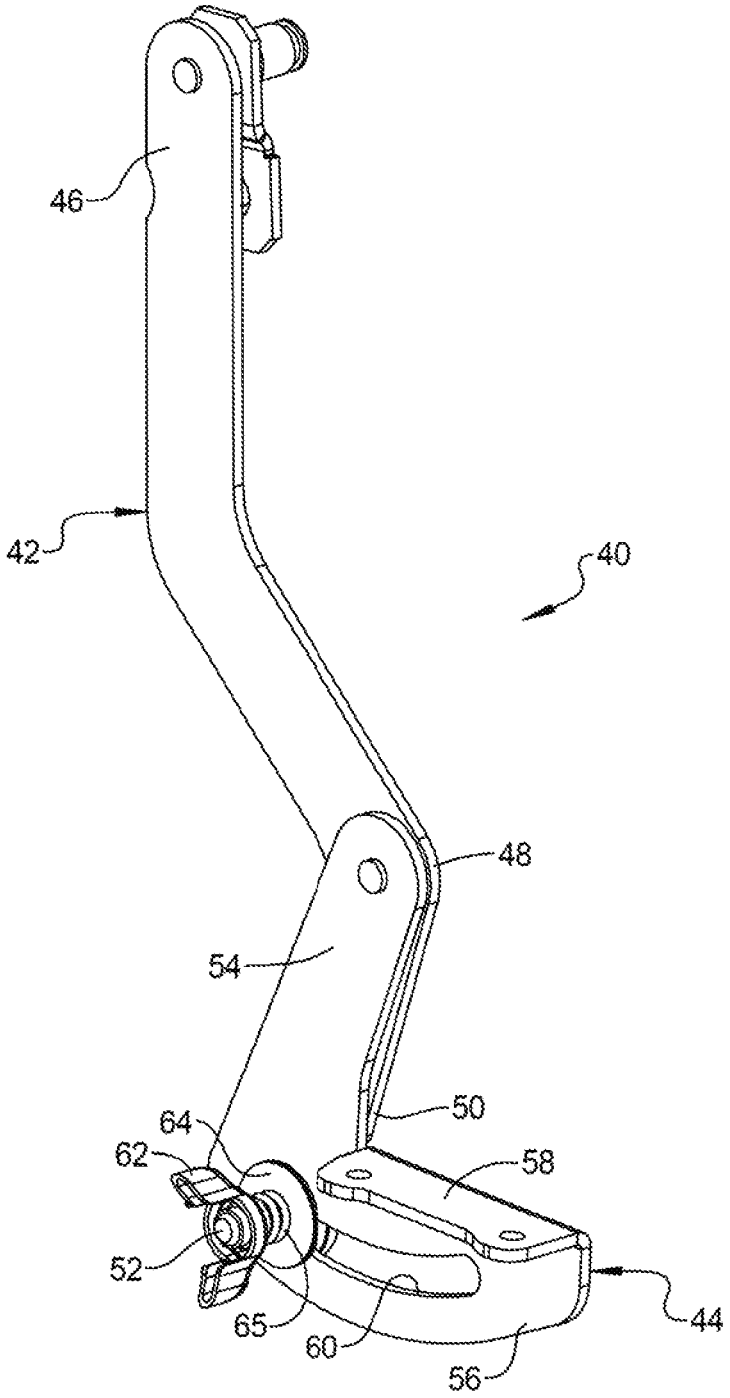
FIG. 5 is a perspective view of a friction-slide mechanism of the furniture member when the seatback is in the upright position.

The seatback 30 is rotatably coupled to the seat bottom 32 by a pair of friction-slide mechanisms 40 (only one of which is shown in the figures). As shown in FIGS. 1 and 5, each friction-slide mechanism 40 may include a lever 42 and a slide member 44. A first end 46 of the lever 42 may be fixedly attached to the seatback 30. An intermediate portion 48 of the lever 42 may be rotatably engaged with the slide member 44. A second end 50 of the lever 42 may include a protrusion 52 (e.g., pin, threaded fastener or rivet) that is slidably engaged with the slide member 44.

As shown in FIG. 5, the slide member 44 may have first and second arms 54, 56 that cooperate to form a generally L-shaped member. The first arm 54 may be rotatably coupled with the intermediate portion 48 of the lever 42. The second arm 56 may include a flange 58 that may be fixedly attached to the seat bottom 32. The second arm 56 may include a curved slot 60 that slidably receives the protrusion 52 of the lever 42. As shown in FIG. 5, a nut 62 and washer 64 may engage the protrusion 52. Threadably tightening the nut 62 against the washer 64 may clamp the slide member 44 between the lever 42 and the nut 62. The tightness of nut 62 can be adjusted to adjust a frictional force between the lever 42 and the slide member 44. While the nut 62 shown in FIG. 5 is a wing nut, it will be appreciated that any type of nut could be used to adjust the frictional force between the lever 42 and the slide member 44. In some embodiments, a compression spring 65 may be disposed on the protrusion 52 between the nut 62 and the slide member 44 (or between the nut 62 and the washer 64). In such configurations, the tightness of the nut 62 could be adjusted to adjust the force of the spring urging the slide member 44 against the lever 42, thereby adjusting the frictional force between the lever 42 and the slide member 44. The frictional force can be adjusted according to the occupant's weight and size.

The seat bottom 32 may include a pair of brackets 66 (only one of which is shown in FIG. 1) fixedly mounted thereto. Each bracket 66 may include a linear slot 68 that slidably receives a rod 70 that is attached to and supported by the seat frame 28.

As shown in FIGS. 1 and 13, as the seatback 30 rotates relative to the seat frame 28 between the upright and reclined positions, the protrusion 52 of each friction-slide mechanism 40 slides along the curved slot 60 of the slide member 44. The friction between the lever 42 and the slide member 44 provides resistance to movement of the seatback 30 between the upright and reclined positions. Furthermore, as the seatback 30 rotates relative to the seat frame 28, the engagement between the lever 42 and slide member 44 rotates the aft end of the seat bottom 32 upward relative to the seat frame 28 and translates the seat bottom 32 forward (i.e., the linear slots 68 of the brackets 66 slide along the rod 70). As will be described in more detail below, this movement of the seat bottom 32 relative to the seat frame 28 drives the wall-proximity mechanism 18 to tilt and translate the entire seat assembly 14 (i.e., the seat frame 28, seatback 30, seat bottom 32 and legrest platform 34) relative to the base frame 12.

Figure 6:
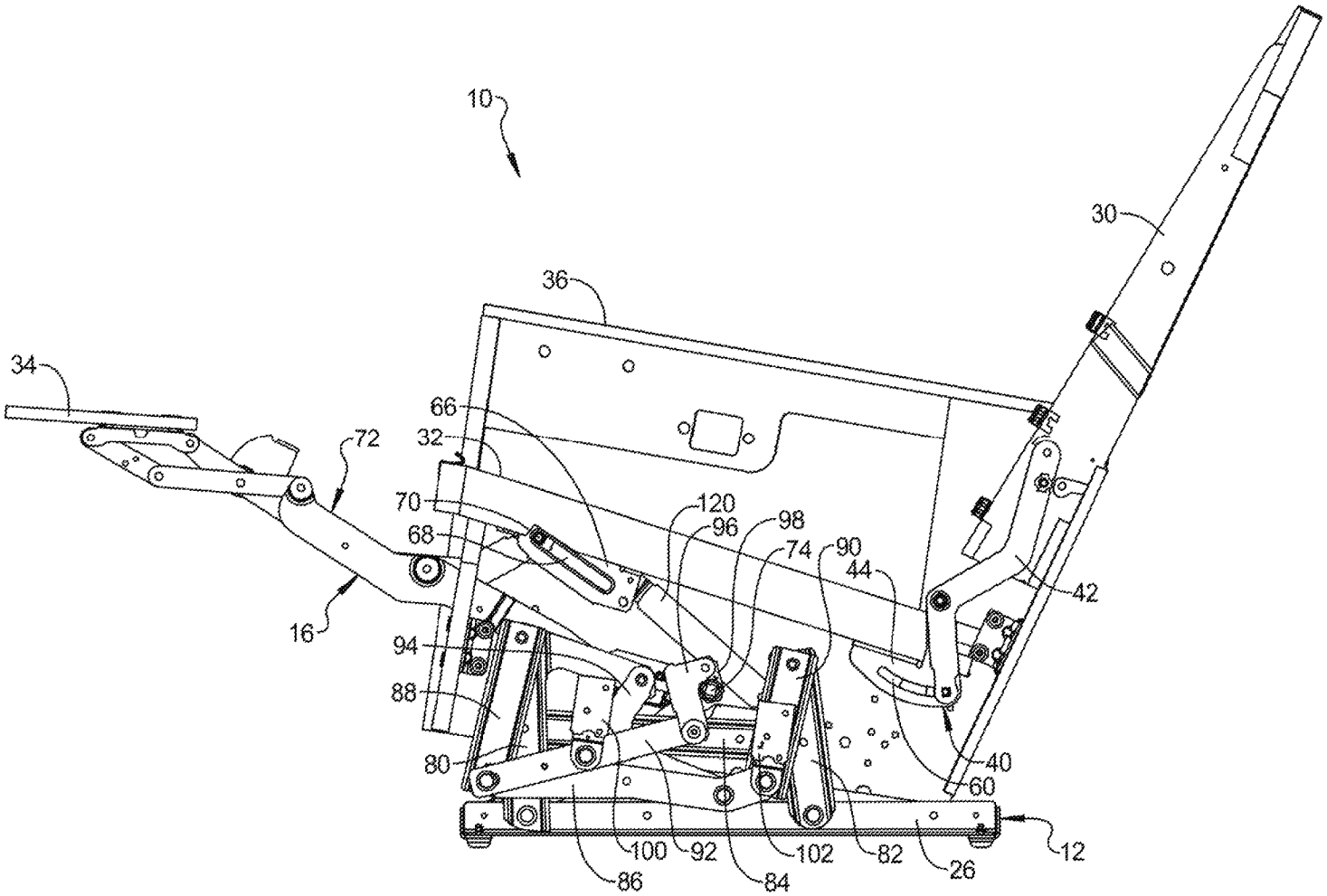
FIG. 6 is a side view of the furniture member with the seatback in the upright position and the legrest in an extended position according to the principles of the present disclosure.
Figure 7:
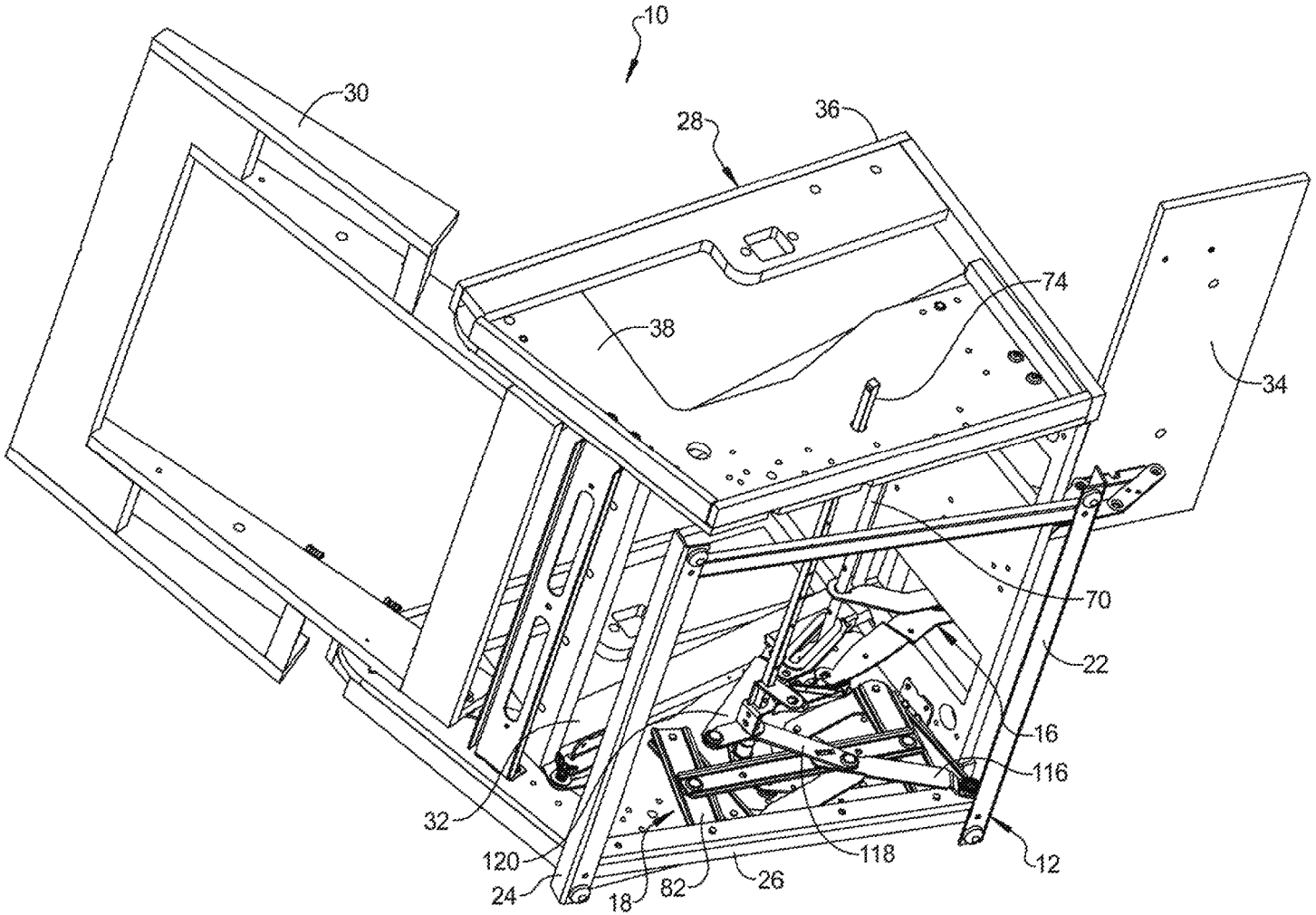
FIG. 7 is a perspective view of the furniture member in the position of FIG. 6.
Figure 8:
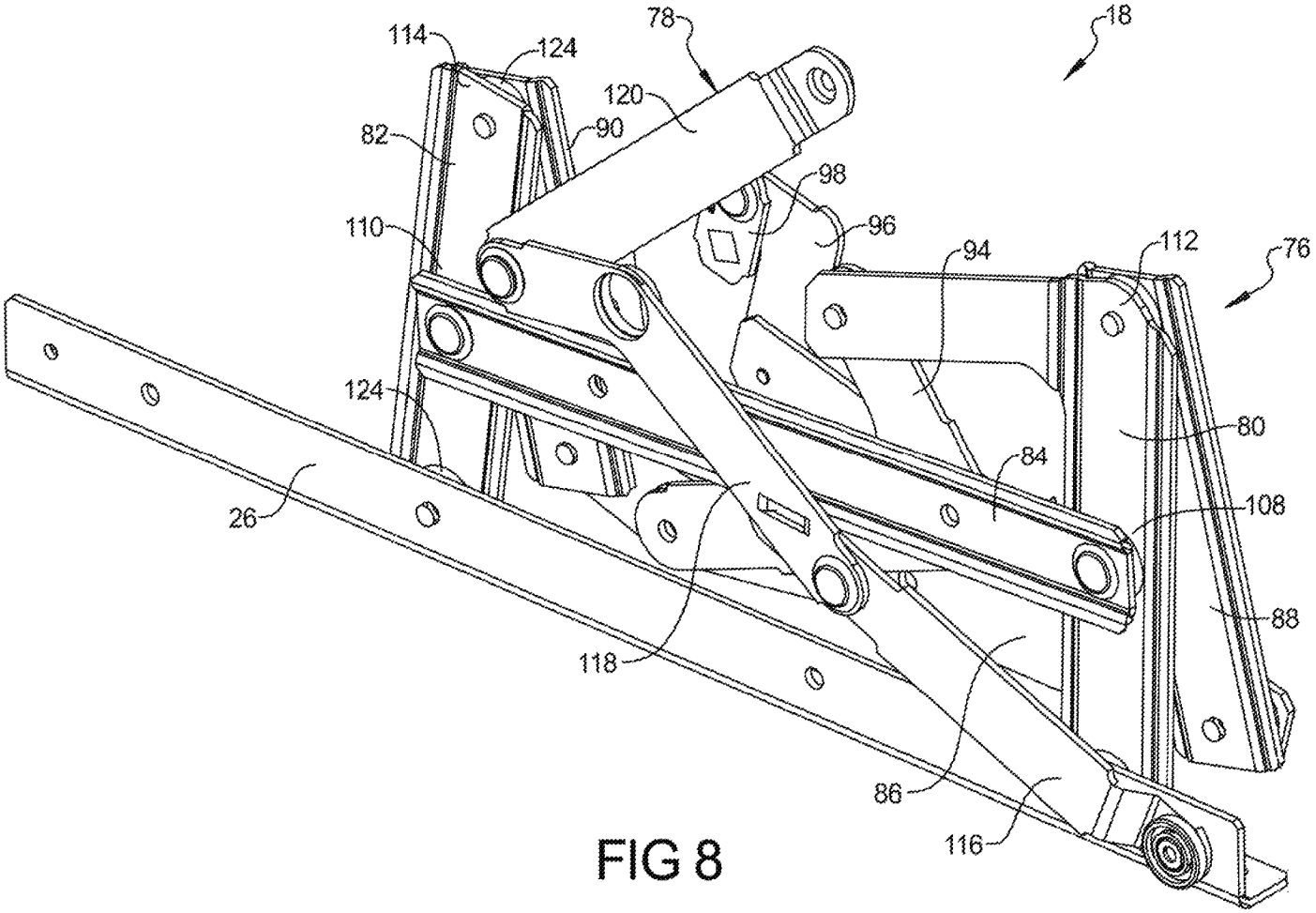
FIG. 8 is a perspective view of the wall-proximity mechanism of the furniture member when the furniture member is in the position of FIG. 6.
Figure 9:
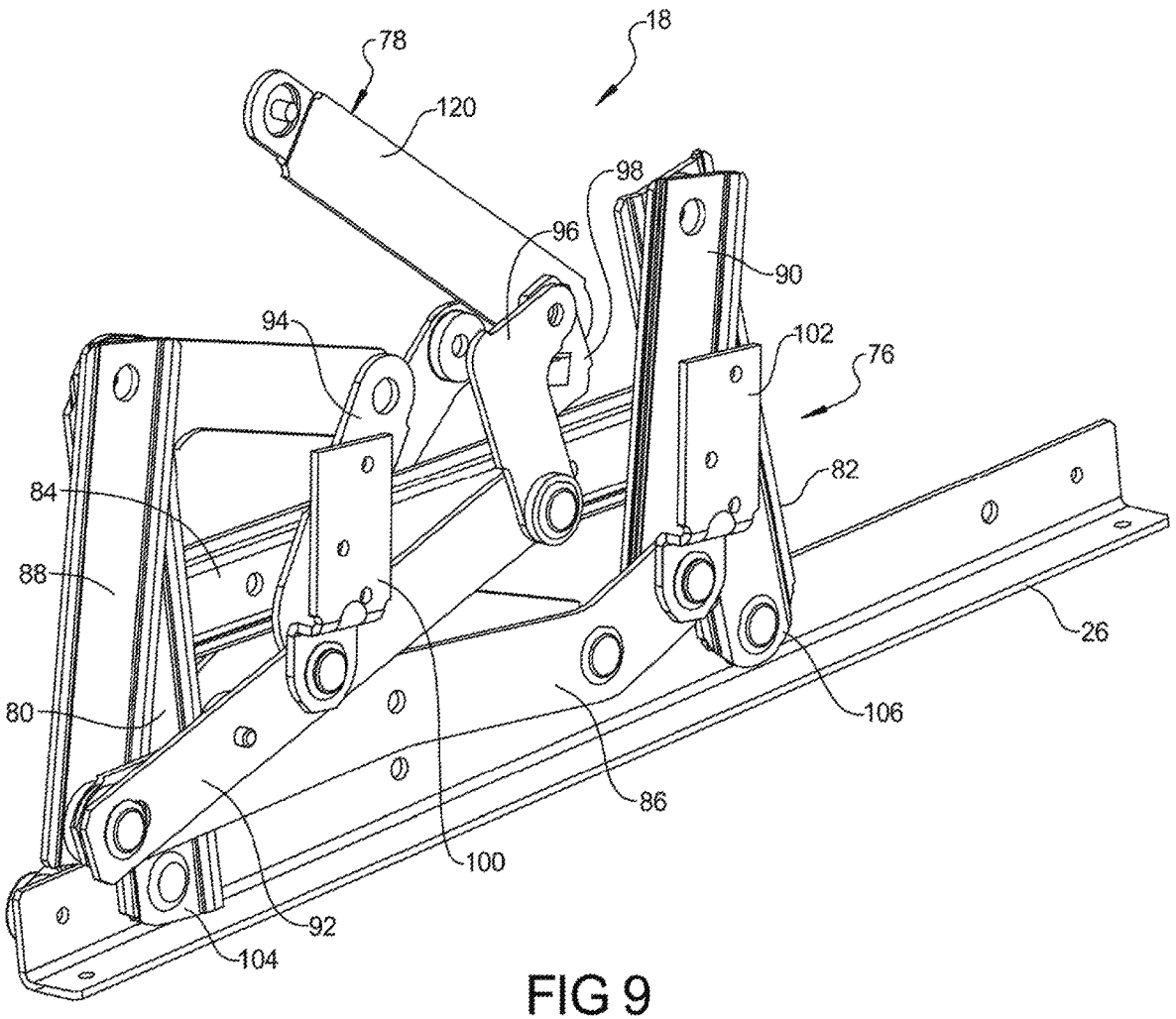
FIG. 9 is a perspective view of the opposite side of the wall-proximity mechanism of the furniture member when the furniture member is in the position of FIG. 6.

As shown in FIGS. 2, 6 and 7, the legrest mechanism 16 may include a pair of pantograph linkages 72 (only one of which is shown in the figures). The pantograph linkages 72 may be coupled to the rod 70, the legrest platform 34, and a drive rod 74. The drive rod 74 may be rotatably supported by the seat frame 28. When the drive rod 74 is rotated relative to the seat frame 28, the drive rod 74 drives the pantograph linkages 72 and legrest platform 34 between the retracted position (FIGS. 1 and 2) the extended position (FIGS. 6 and 7). While not shown in the figures, a handle may be attached to an end of the drive rod 74 on an exterior side of the seat frame 28 so that a person seated in the furniture member 10 can grasp and rotate the handle to rotate the drive rod 74. In some configurations, the drive rod 74 may be attached to and driven by a drive motor (not shown). As will be described in more detail below, the drive rod 74 may be coupled to the wall-proximity mechanism 18 so that rotation of the drive rod 74 causes the wall-proximity mechanism 18 to tilt the seat assembly 14 relative to the base frame 12, as shown in FIGS. 1 and 6.

Figure 3:
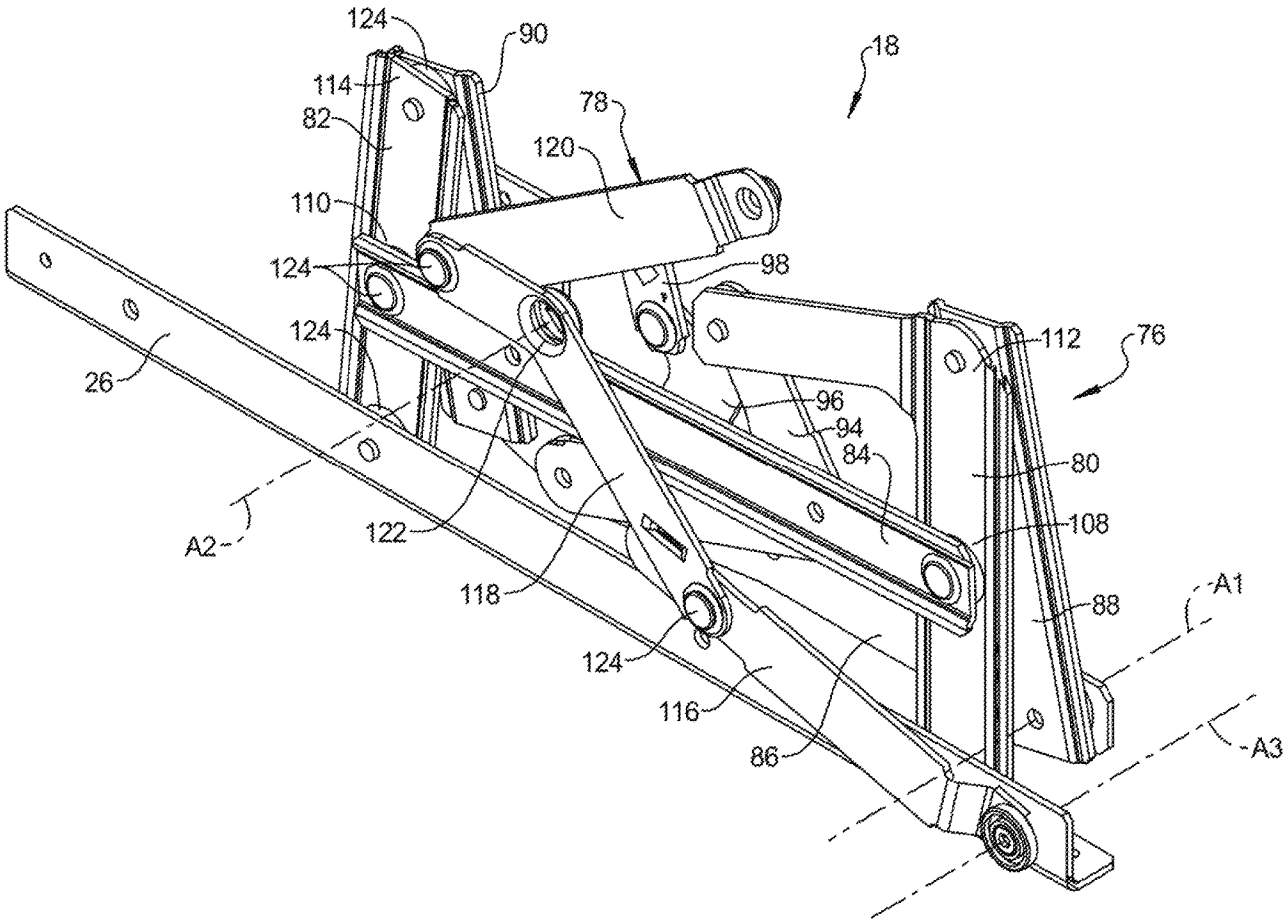
FIG. 3 is a perspective view of a wall-proximity mechanism of the furniture member when the furniture member is in the position of FIG. 1.
Figure 4:
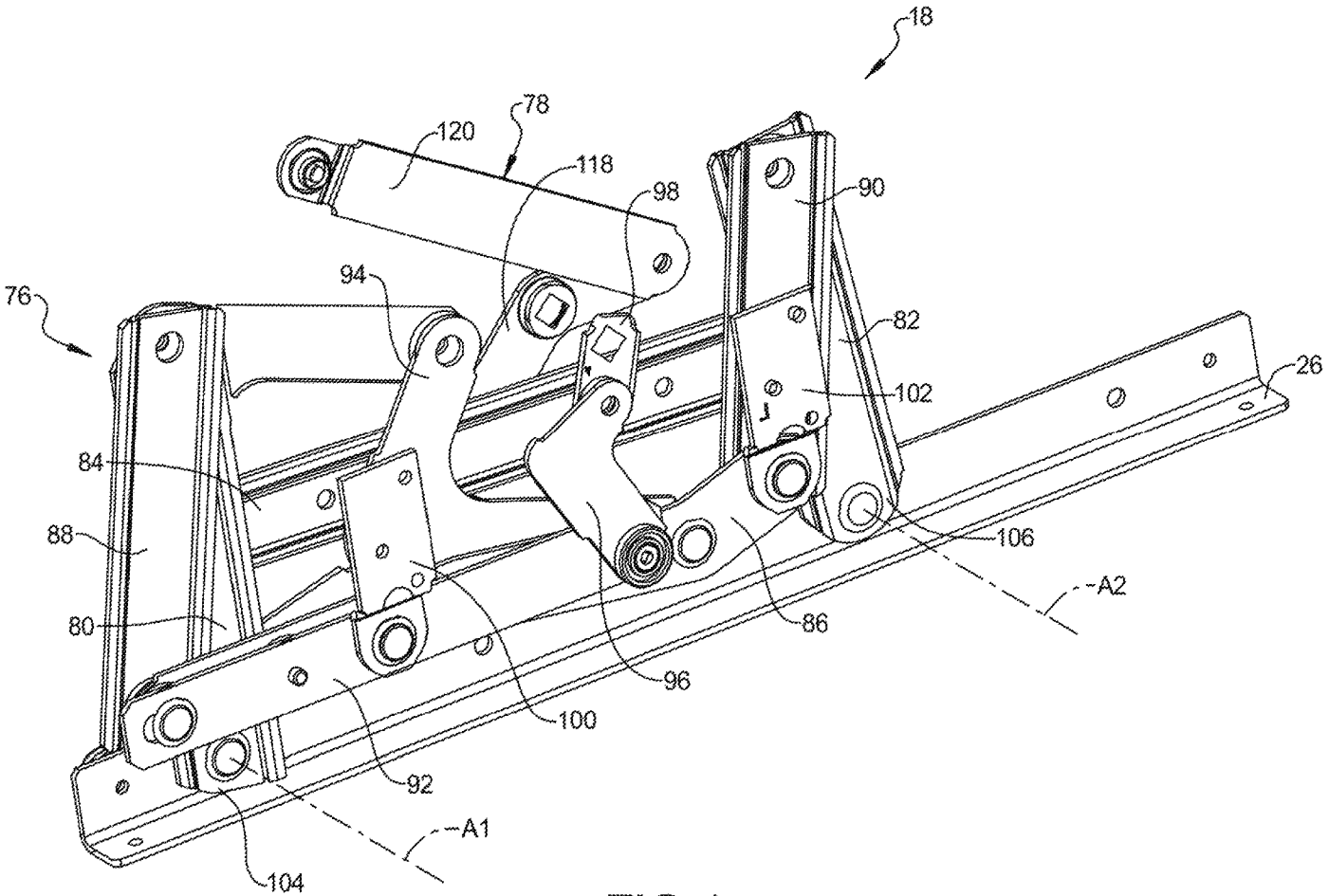
FIG. 4 is a perspective view of an opposite side of the wall-proximity mechanism of the furniture member when the furniture member is in the position of FIG. 1.

The wall-proximity mechanism 18 may include a pair of first linkages 76 (only one of which is shown in the figures) and a pair of second linkages 78 (only one of which is shown in the figures). As shown in FIGS. 3 and 4, each of the first linkages 76 may include a first motion link 80, a second motion link 82, a first cross member 84, a second cross member 86, a first control link 88, a second control link 90, a first connecting link 92, a second connecting link 94, a third connecting link 96, a crank link 98, a first mounting link 100, and a second mounting link 102.

First ends 104, 106 (FIGS. 1 and 4) of the first and second motion links 80, 82 may be mounted to the corresponding side support member 26 of the base frame 12 and are pivotable relative to the base frame 12 about first and second rotational axes A1, A2, respectively, that extend through the side support members 26 of the base frame 12 and are fixed relative to the base frame 12. The first cross member 84 may be pivotably connected to intermediate portions 108, 110 (FIG. 3) of the first and second motion links 80, 82, respectively. The first and second control links 88, 90 may be pivotably connected to second ends 112, 114 of the first and second motion links 80, 82, respectively. The second cross member 86 may have ends pivotably connected to ends of the first and second control links 88, 90. The first connecting link 92 may be pivotably connected to one of the ends of the second cross member 86. The second connecting link 94 may be pivotably connected to an intermediate portion of the second cross member 86 and may be pivotably connected to the first motion link 80. The crank link 98 may be rotationally fixed to the drive rod 74 and may be pivotably connected to the third connecting link 96. The third connecting link 96 may also be pivotably connected to the first connecting link 92. The first and second mounting links 100, 102 may be fixedly attached to the seat frame 28. The first mounting link 100 may be pivotably connected to an intermediate portion of the first connecting link 92. The second mounting link 102 may be pivotably connected to the second cross member 86.

As shown in FIG. 3, each of the second linkages 78 of the wall-proximity mechanism 18 may include a first pull link 116, a second pull link 118, and a third pull link 120. Opposite ends of the first pull link 116 may be pivotably mounted to an end of the second pull link 118 and the side support member 26, respectively. The first pull link 116 is rotatable relative to the side support member 26 about a third rotational axis A3 that extends through the side support member 26 and is fixed relative thereto. The rotational axes A1, A2, A3 may all be spaced apart from each other along the length of the side support member 26. Another end of the second pull link 118 may be pivotably coupled to the third pull link 120. The drive rod 74 may extend through an aperture 122 in an intermediate portion of the second pull link 118. The drive rod 74 is not rotationally keyed to the second pull link 118, which allows the drive rod 74 to rotate relative to the second pull link 118. The third pull link 120 is pivotably coupled to the bracket 66 of the seat bottom 32.

Figure 17:
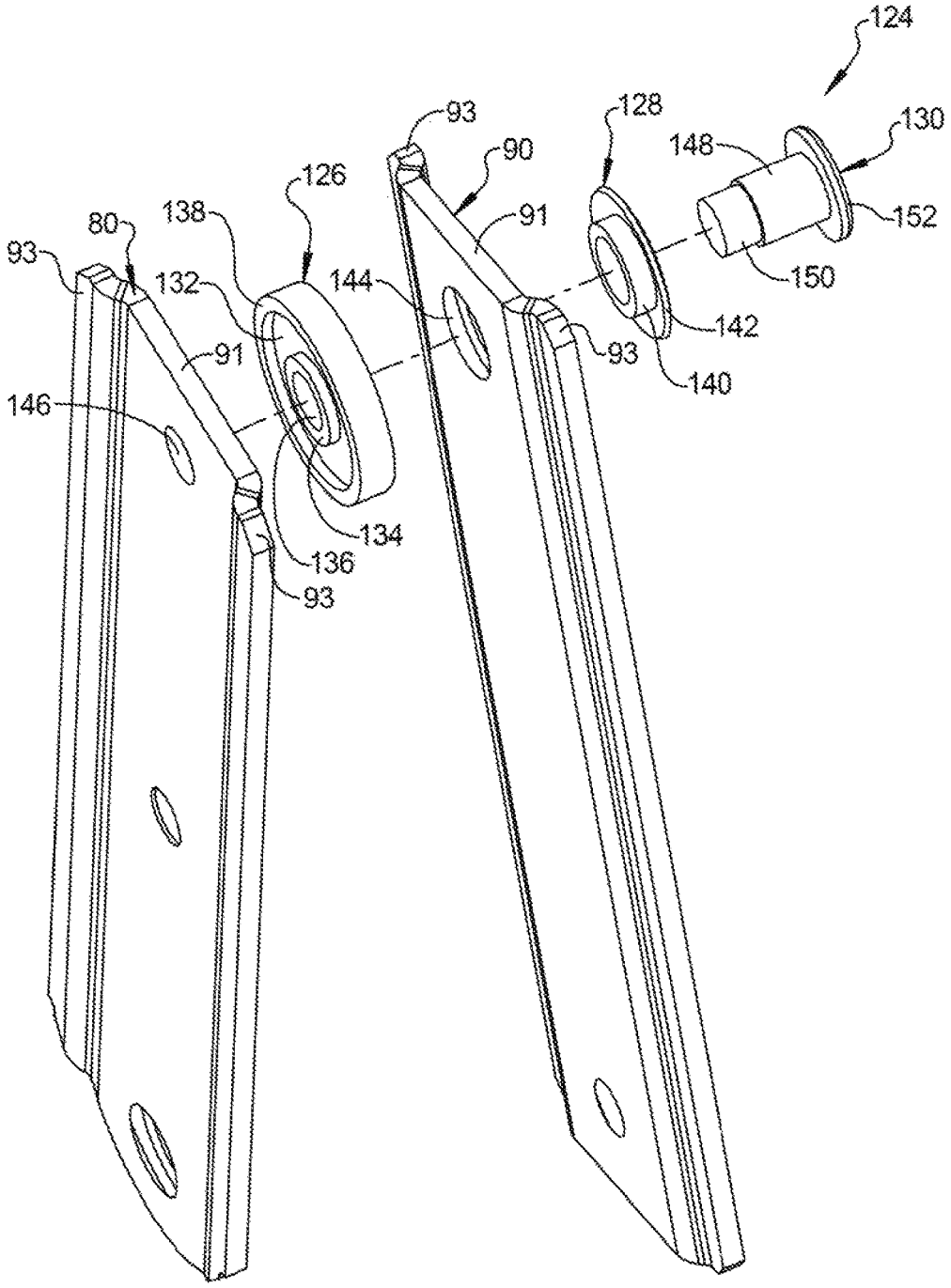
FIG. 17 is an exploded view of a rotatable joint assembly according to the principles of the present disclosure.
Figure 18:
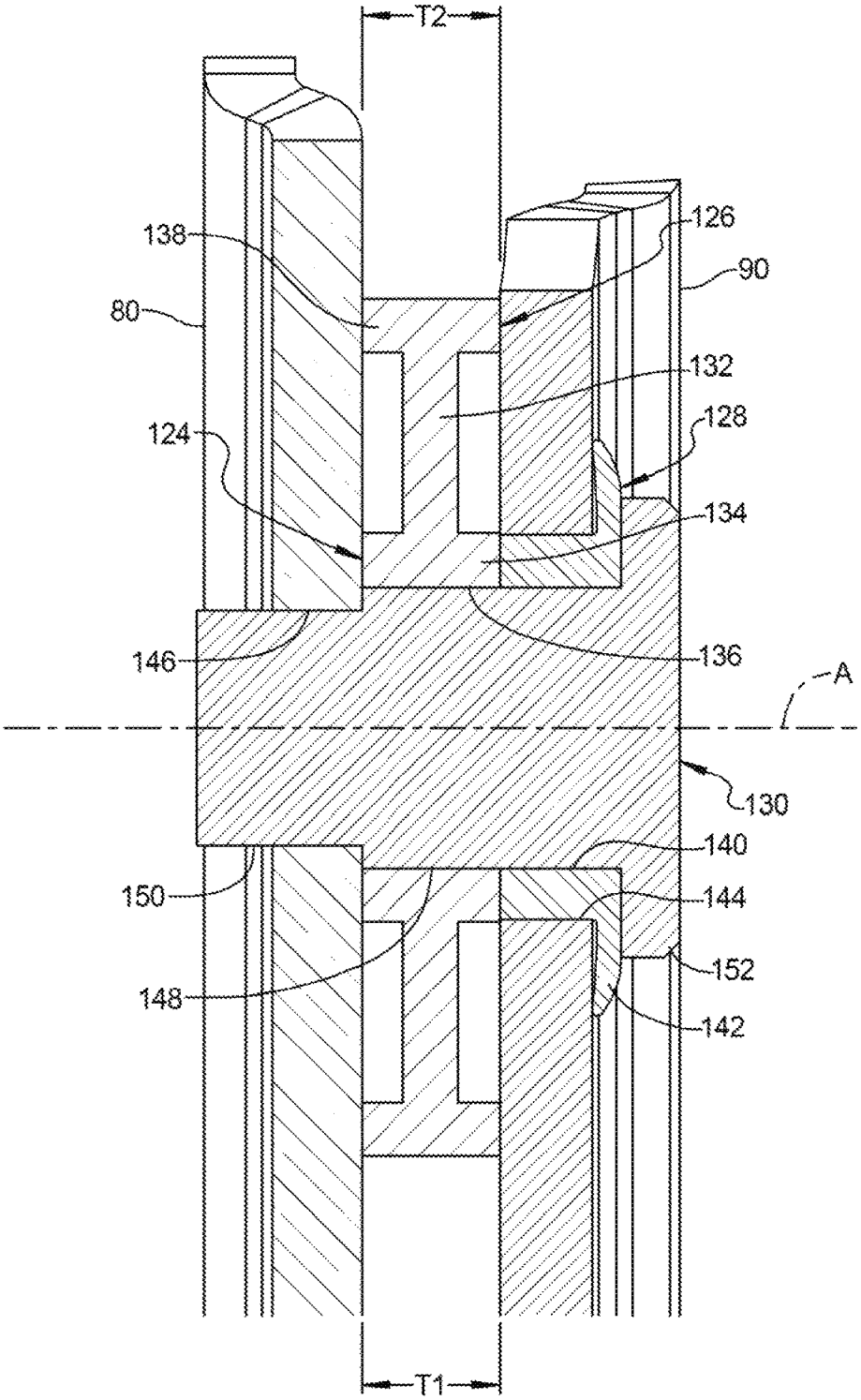
FIG. 18 is a cross-sectional view of the rotatable joint assembly of FIG. 17.

One or more of the first and second linkages 76, 78 may include one or more rotatable joint assemblies 124 (FIGS. 17 and 18). Any one or more of the rotatable or pivotable joints of the first and/or second linkages 76, 78 may include the joint assembly 124. For example, FIGS. 17 and 18 depict one of the joint assemblies 124 coupling the second motion link 82 to the second control link 90 for relative rotation therebetween. Each joint assembly 124 may include a bushing 126, a grommet 128 and a rivet 130 or other fastener.

The bushing 126 may include an annular body 132, an annular inner flange 134 defining a central aperture 136, and an annular outer flange 138 surrounding a radially outer periphery of the body 132 and surrounding the annular inner flange 134. The inner flange 134 has a first axial thickness T1 (i.e., a dimension in a direction parallel to rotational axis A). The outer flange 138 has a second axial thickness T2 that is greater than the first axial thickness T1. For example, the first axial thickness T1 may be about 0.180 inches, and the second axial thickness T2 may be about 0.190 inches. An axial thickness of the body 132 may be smaller than the first and second axial thicknesses T1, T2. The inner and outer flanges 134, 138 may extend axially (i.e., in directions parallel to rotational axis A) outward from both axial ends of the body 132.

The grommet 128 may include a tubular portion 140 and a flange portion 142 extending radially outward from the tubular portion 140. The tubular portion 140 may be received (e.g., press fit) within an aperture 144 in the link 90. The flange portion 142 may abut the link 90. The rivet 130 may extend through the tubular portion 140, through the aperture 144 in the link 90, through the central aperture 136 of the bushing 126, and through an aperture 146 in the link 80. The rivet 130 may include a first shaft portion 148, a second shaft portion 150, and a head 152. The first shaft portion 148 may have a larger diameter than the second shaft portion 150 and may be disposed axially between the second shaft portion 150 and the head 152. The second shaft portion 150 may be press fit within the aperture 146 in the link 80. The first shaft portion 148 may have enough clearance within the central aperture 136 of the bushing 126 and within the tubular portion 140 of the grommet 128 to allow the links 80, 90 to rotate relative to each other about rotational axis A. While the tubular portion 140 is described above as being press fit within the aperture 144, in some configurations, the tubular portion 140 could be slip fit into the aperture 144 and the rivet 130 may be peened to fixedly secure the grommet 128.

The difference in the axial thicknesses of the inner and outer flanges 134, 138 of the bushing 126 allows for the links 80, 90 to locally deform at the joint assembly 124 until the links 80, 90 come into contact with their corresponding sides of both of the flanges 134, 138. That is, because the inner flange 134 has a smaller axial thickness than the outer flange 138, the links 80, 90 may locally deform or "cup" inward toward each other when the rivet 130 is fully pressed into engagement in the aperture 146 of the link 80, thereby preloading the joint to reduce wobble and increase stiffness. Furthermore, the bushing 126 can be sized to increase the contact diameter between the bushing 126 and the links 80, 90.

The overall axial thickness of the bushing 126 offsets the links 80, 90 along the rotational axis A, which eliminates the need for offsets to be formed into the links 80, 90 to provide clearance between the links 80, 90. Eliminating the need for link offsets may substantially increase the bending strength of the links and allows for the links to have cross-sectional shapes (profiles) that further enhance the bending strength of the links. That is, one or more of the links 80, 82, 88, 90 may include a cup-shaped profile that increases the stiffness of the links 80, 82, 88, 90 and allows for the use of thinner material without loss of bending strength or compressive load bearing. As shown in FIG. 17, the cup-shaped profile of the links 80, 82, 88, 90 may include a flat center section 91 and curved lateral edge portions 93 that cooperate to form the cup-shaped profile. It will be appreciated that any or all of the links of the linkages 78 could include the cup-shaped profile and could be connected to other links via the joint assemblies 124 described above.

The structures of the links 80, 82, 88, 90 (e.g., the cup-shaped profile) and the bushing 126 and the engagement between the bushing 126 and the links 80, 82, 88, 90 described above provide for a more stable joint that reduces or eliminates side-to-side wobble of the links 80, 82, 88, 90 as the links 80, 82, 88, 90 rotate relative to each other, thereby eliminating the need for one or more cross members spanning between the two linkages 78 (i.e., the linkages 78 on both sides of the furniture member 10) and allowing for the pantograph linkages 72 of the legrest mechanism 16 to be relatively centrally located. As described above, any or all of the rotational couplings between the links of the legrest mechanism 16 and the wall-proximity mechanism 18 can include joint assemblies 124 to reduce side-to-side wobble of the mechanisms 16, 18.

In some configurations, the links that are connected to each other by the joint assembly 124 have continuous cross-sectional profiles (e.g., the cup-shaped profile) that extend the entire longitudinal lengths of the links. Such continuous cross-sectional profiles are not possible in many prior-art linkages. For example, in the case of a prior-art linkage with straight links having simple ribs applied thereto, the ribs must be ended to allow clearance for the pivotal connection of one link to another. Because such ribs do not extend over the entire longitudinal length of the link, the link will have areas of lower bending strength. The cup-shaped cross-sectional profile of the present disclosure that extends over the entire longitudinal length of the link in conjunction with the spacing provided by the bushing 126 maximizes bending strength of the assembly through the entire joint area.

With reference to FIGS. 1-16, operation of the furniture member 10 will be described in detail. As described above, the wall-proximity mechanism 18 tilts the seat assembly 14 rearward relative to the base frame 12 as the legrest mechanism 16 moves the legrest platform 34 from the retracted position to the extended position, as shown in FIGS. 1 and 6. That is, rotation of the drive rod 74 moves the pantograph linkages 72 toward the extended position and simultaneously rotates the crank link 98 of the wall-proximity mechanism 18. Rotation of the crank link 98 causes upward movement of the third connecting link 96, which causes rotation of the first connecting link 92 and upward movement of the first mounting link 100 (compare FIGS. 1 and 6), thereby tilting the entire seat assembly 14 (i.e., the seat frame 28, seatback 30, seat bottom 32 and legrest platform 34) rearward relative to the base frame 12 and translating the seat assembly 14 forward relative to the base frame 12.

As shown in FIGS. 10-16 and as described above, rotation of the seatback 30 relative to the seat frame 28 from the upright position to the reclined position causes the protrusion 52 of each friction-slide mechanism 40 to slide along the curved slot 60 of the slide member 44. The friction between the lever 42 and the slide member 44 provides resistance to movement of the seatback 30 between the upright and reclined positions. Furthermore, as the seatback 30 rotates relative to the seat frame 28, the engagement between the lever 42 and slide member 44 rotates the aft end of the seat bottom 32 upward relative to the seat frame 28 and translates the seat bottom 32 forward (i.e., the linear slots 68 of the brackets 66 slide along the rod 70).

This movement of the seat bottom 32 relative to the seat frame 28 drives the wall-proximity mechanism 18 to further tilt the entire seat assembly 14 (i.e., the seat frame 28, seatback 30, seat bottom 32 and legrest platform 34) rearward relative to the base frame 12 and translate the entire seat assembly 14 forward relative to the base frame 12. The forward movement of the seat bottom 32 causes corresponding movement of the third pull link 120, which causes corresponding movement of the first and second pull links 116, 118. Because the drive rod 74 extends through the aperture 122 of the second pull link 118, forward movement of the seat bottom 32 causes the pull links 116, 118, 120 to pull the drive rod 74 forward, which in turn, causes the first linkage 76 to move (since the drive rod 74 is also engaged with the crank link 98 of the first linkage 76). In this manner, rearward rotation of the seatback 30 causes the wall-proximity mechanism 18 to tilt and translate the seat assembly 14.

The forward translation of the seat assembly 14 relative to the base frame 12 eliminates or reduces the amount of clearance that is needed between the furniture member 10 and a wall (or other object) to allow the seatback 30 to be moved into the fully reclined position. In some configurations, only about 6.5 inches or less of clearance is needed between a wall and a rearward-most edge of the seatback 30 (when the seatback 30 is in the fully upright position with the legrest fully retracted) so that the wall will not impede the motion of the seatback 30 to the fully reclined position with the legrest mechanism 16 fully extended.

The wall-proximity mechanism 18 may be or include a linkage that converts rotation of the links of the mechanism 18 into approximately straight-line translation of the seat frame 28. The approximate straight-line translation of the wall-proximity mechanism 18 allows for the forward/rearward movement of the mechanism 18 without unwanted raising or lowering of the seat frame 28 and a person seated on the seat frame 28. Specifically, cooperation between the first motion link 80, the first control link 88, the second connecting link 94 and the second cross member 86 causes the approximate straight-line translation of the seat frame 28 relative to the base frame 12. The second control link 90 and the second motion link 82 may function as follower links and support the rear portion of the mechanism 18 during traverse and are connected to the front of the mechanism 18 by the first cross member 84 and the first motion link 80.

Reducing or eliminating unwanted raising and lowering is important because if unwanted raising or lowering were to occur during traverse, it would cause unbalance during rotation of the seatback 30 during recline (i.e., too little or too much force would be required to rotate the seatback 30 between upright and reclined positions). In some configurations, the wall-proximity mechanism 18 translates the seat frame 28 forward approximately 8-9 inches, while deviating from straight-line travel by approximately 0.040 inches (i.e., the seat frame 28 may be lifted upward approximately 0.040 inches over 8-9 inches of translation). Because the seat frame 28 is lifted vertically upward only a very small amount over the range of translation, less force is required to rotate the seatback 30 from the upright position to the reclined position.

Furthermore, the linkages 76, 78 of the wall-proximity mechanism 18 include only links that are rotatably coupled to each other, and do not include tracks along which links must roll or slide. Eliminating tracks and rollers/wheels may improve the longevity and reliability of the mechanism 18 and improve the smoothness of the motion of the mechanism 18. This is because tracks (especially curved tracks) can accumulate dirt and debris (especially at low points of a curved track) that can cause binding and/or bumpy motion as the rollers roll over the dirt and debris as they travel along the track. The mechanism 18 eliminates wheels/rollers and tracks found in prior-art mechanism, while still providing adequate wall-away functionality.

While the furniture member 10 is shown in the figures as a chair, it will be appreciated that the furniture member 10 could be any other motion-furniture item, such as a sofa or loveseat, for example, and the principles of the present disclosure can be applied to such furniture items.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A furniture member comprising:

a base frame;

a seat assembly supported by the base frame and including a seat frame, a seat bottom, a seatback and a legrest, the legrest movable relative to the base frame and seat frame between a retracted position and an extended position, the seatback movable relative to the base frame and seat frame independently of the legrest between an upright position and a reclined position;

a drive rod rotatably mounted to the seat frame;

a legrest mechanism attached to the legrest and the seat frame and driven by the drive rod to move the legrest between the retracted and extended positions; and a wall-proximity mechanism connected to the base frame, the seat assembly and the drive rod to tilt the seat frame rearward relative to the base frame and translate the seat frame forward relative to the base frame in response to rotation of the drive rod and movement of the seatback between the upright and reclined positions, the wall-proximity mechanism including a first motion link and a second motion link that are mounted to the base frame and pivotable relative to the base frame about first and second rotational axes, respectively, the first and second rotational axes extend through the base frame and are fixed relative to the base frame, wherein the wall-proximity mechanism includes a first linkage including the first and second motion links, a first cross member pivotably connected to intermediate portions of the first and second motion links, first and second control links pivotably connected to second ends of the first and second motion links, respectively, a second cross member having ends pivotably connected to ends of the first and second control links, a first connecting link pivotably connected to one of the ends of the second cross member, a second connecting link pivotably connected to an intermediate portion of the second cross member and pivotably connected to the first motion link, a crank link rotationally fixed to the drive rod and pivotably connected to a third connecting link that is also pivotably connected to the first connecting link, and first and second mounting links fixedly attached to the seat frame, the first mounting link pivotably connected to an intermediate portion of the first connecting link, the second mounting link pivotably connected to the second cross member.

2. The furniture member of claim 1, wherein the wall-proximity mechanism includes a second linkage including a first pull link, a second pull link, and a third pull link, the first pull link pivotably connected to the base frame and to the second pull link, the second pull link is pivotably coupled to the drive rod and pivotably coupled to the third pull link, the third pull link is pivotably coupled to the seat bottom.

3. The furniture member of claim 2, wherein the first pull link is rotatable relative to the base frame about a third rotational axis that extends through the base frame and is fixed relative to the base frame.

4. The furniture member of claim 1, wherein the wall-proximity mechanism is non-slidably and non-rollingly connected to the seat bottom and to the base frame.

5. The furniture member of claim 1, wherein the legrest mechanism includes a pantograph linkage connected to the drive rod.

6. The furniture member of claim 1, further comprising a friction-slide mechanism including a lever fixedly attached to the seatback and a slide member fixedly attached to the seat bottom, the lever including a protrusion slidably received within a curved slot formed in the slide member.

7. The furniture member of claim 6, wherein the lever rotatably engages the slide member at a location that is spaced apart from the protrusion and the curved slot.

8. The furniture member of claim 7, further comprising means for adjusting a frictional force between the lever and the slide member.

9. The furniture member of claim 1, further comprising a joint assembly rotatably coupling two links and including a bushing disposed between the two links, the bushing including a central aperture that is aligned with apertures in the two links, an inner annular flange surrounding the central aperture, and an outer annular flange surrounding the inner flange.

10. The furniture member of claim 9, wherein the bushing provides clearance for the two links to move relative to each other, and wherein the two links have continuous cross-sectional profiles that extend the entire longitudinal lengths of the two links.

11. The furniture member of claim 9, wherein the inner annular flange has a first thickness and the outer annular flange has a second thickness that is greater than the first thickness, the first and second thicknesses are measured in a direction parallel to an axis about which the two links are rotatably coupled, the difference between the first and second thicknesses of the inner and outer annular flanges locally deforms the two links.

12. The furniture member of claim 11, further comprising a rivet extending through the central aperture and the apertures in the two links.

13. The furniture member of claim 12, wherein the two links include cup-shaped cross-sectional profiles that extend the entire longitudinal lengths of the two links.

14. The furniture member of claim 13, wherein one of the two links includes the first motion link or the second motion link.

15. A furniture member comprising:

a base frame;

a seat assembly supported by the base frame and including a seat frame, a seat bottom, a seatback and a legrest, the legrest movable relative to the base frame and seat frame between a retracted position and an extended position, the seatback movable relative to the base frame and seat frame between an upright position and a reclined position;

a drive rod rotatably mounted to the seat frame;

a legrest mechanism attached to the legrest and the seat frame by a first plurality of links, the legrest mechanism driven by the drive rod to move the legrest between the retracted and extended positions;

a wall-proximity mechanism connected to the base frame and to the seat assembly by a second plurality of links to tilt the seat frame rearward relative to the base frame and translate the seat frame forward relative to the base frame; and a joint assembly rotatably coupling two links from among the first and second pluralities of links, the joint assembly including a bushing disposed between the two links, the bushing including a central aperture that is aligned with apertures in the two links, an inner annular flange surrounding the central aperture, and an outer annular flange spaced radially outward from the inner flange by an annular body, the outer annular flange radially surrounding the inner flange such that both of the inner and outer annular flanges engage both of the two links and provide clearance between the two links.

16. The furniture member of claim 15, wherein the bushing provides clearance for the two links to move relative to each other, and wherein the two links have continuous cross-sectional profiles that extend the entire longitudinal lengths of the two links.

17. The furniture member of claim 15, wherein the inner annular flange has a first thickness and the outer annular flange has a second thickness that is greater than the first thickness, the first and second thicknesses are measured in a direction parallel to an axis about which the two links are rotatably coupled, the difference between the first and second thicknesses of the inner and outer annular flanges locally deforms the two links.

18. The furniture member of claim 17, further comprising a rivet extending through the central aperture and the apertures in the two links.

19. The furniture member of claim 18, wherein the two links include cup-shaped cross-sectional profiles that extend the entire longitudinal lengths of the two links.

20. The furniture member of claim 15, wherein the wall-proximity mechanism tilts the seat frame rearward relative to the base frame and translates the seat frame forward relative to the base frame in response to rotation of the drive rod and movement of the seatback between the upright and reclined positions.

21. The furniture member of claim 20, wherein the wall-proximity mechanism includes a first motion link and a second motion link that are mounted to the base frame and pivotable relative to the base frame about first and second rotational axes, respectively, the first and second rotational axes extend through the base frame and are fixed relative to the base frame.

22. The furniture member of claim 21, wherein the wall-proximity mechanism includes a first linkage including the first and second motion links, a first cross member pivotably connected to intermediate portions of the first and second motion links, first and second control links pivotably connected to second ends of the first and second motion links, respectively, a second cross member having ends pivotably connected to ends of the first and second control links, a first connecting link pivotably connected to one of the ends of the second cross member, a second connecting link pivotably connected to an intermediate portion of the second cross member and pivotably connected to the first motion link, a crank link rotationally fixed to the drive rod and pivotably connected to a third connecting link that is also pivotably connected to the first connecting link, and first and second mounting links fixedly attached to the seat frame, the first mounting link pivotably connected to an intermediate portion of the first connecting link, the second mounting link pivotably connected to the second cross member.

23. The furniture member of claim 22, wherein the wall-proximity mechanism includes a second linkage including a first pull link, a second pull link, and a third pull link, the first pull link pivotably connected to the base frame and to the second pull link, the second pull link is pivotably coupled to the drive rod and pivotably coupled to the third pull link, the third pull link is pivotably coupled to the seat bottom.

24. The furniture member of claim 23, wherein the first pull link is rotatable relative to the base frame about a third rotational axis that extends through the base frame and is fixed relative to the base frame.

25. The furniture member of claim 15, wherein the legrest mechanism includes a pantograph linkage connected to the drive rod.

26. The furniture member of claim 15, further comprising a friction-slide mechanism including a lever fixedly attached to the seatback and a slide member fixedly attached to the seat bottom, the lever including a protrusion slidably received within a curved slot formed in the slide member.

27. The furniture member of claim 26, wherein the lever rotatably engages the slide member at a location that is spaced apart from the protrusion and the curved slot.

28. The furniture member of claim 27, further comprising means for adjusting a frictional force between the lever and the slide member.

* * * * *